United States Patent [19]

Coates

[11] Patent Number: 4,754,716

[45] Date of Patent: Jul. 5, 1988

[54] REFRACTORY SHIELD REMOVABLE TOE

[75] Inventor: Stephen J. Coates, Galena, Ill.

[73] Assignee: Merkle Engineers, Inc., Galena, Ill.

[21] Appl. No.: 50,625

[22] Filed: May 15, 1987

[51] Int. Cl.[4] ..... F23M 5/06

[52] U.S. Cl. ..... 110/334; 110/331

[58] Field of Search ..... 110/334, 331, 335; 52/127.1, 486

[56] References Cited

U.S. PATENT DOCUMENTS 2,272,015 2/1942 Lanyon ..... 110/334

2,457,965 1/1949 Young ..... 110/334

*Primary Examiner*—Edward G. Favors

*Attorney, Agent, or Firm*—Thomas W. Speckman; Ann W. Speckman

[57] ABSTRACT

A removable refractory shield toe assembly for a suspended refractory shield wherein a hanger suspension means extends substantially the length of the toe assembly suspending a plurality of adjacent refractories on at least one metallic refractory hanger, a toe assembly suspension means extending upwardly from the hanger suspension means and having lifting means positioned in an outer upward location outwardly from a vertical axis through the center of gravity of the removable toe assembly and having hanging means positioned in an inner upward location inwardly from the vertical axis whereby the removable toe assembly rotates outwardly spacing the inner face of the innermost of the plurality of refractories from the outer face of the outermost fixed refractory of a suspended refractory shield when the weight of the removable toe assembly is upon the lifting means and the removable toe assembly rotates inwardly urging the inner face against the outer face of the fixed refractory when the weight of the removable toe assembly is upon the hanging means. The removable refractory toe assembly allows replacement of a plurality of lower refractories from the outside of a curved wall, high temperature furnace construction.

16 Claims, 2 Drawing Sheets

REFRACTORY SHIELD REMOVABLE TOE

BACKGROUND OF THE INVENTION

1. Field of the Invention

This invention relates to improvements in high temperature industrial furnaces. More particularly, this invention relates to a removable toe portion for a suspended refractory shield for a high temperature industrial furnace.

2. Description of the Prior Art

Suspended refractory shields for high temperature furnaces and the importance of cooling of metal hangers supporting the refractories in such construction is known, such as taught by U.S. Pat. No. 3,812,798. Suspended refractory wall construction frequently involves turns or nose constructions which have their center of radius outside the cold side of the furnace, such as in the bottom of a feeder wall. Prior such construction, as shown in FIG. 2 of U.S. Pat. No. 3,812,798 have a fixed curved hanger portion from which the refractories are suspended with the necessity for a spring biased plate to urge the refractories forming the curved portion upwardly to maintain their position and to accommodate temperature changes during furnace operation. Frequently, the toe portion of the refractory shield is at the location of intense heat and in contact with batch constituents which cause deterioration requiring replacement of the extreme lower refractories of the curved structure. In order to replace the lower refractories of the curved structure as shown in FIG. 2 of the U.S. Pat. No. 3,812,798, it is necessary to disassemble the entire length of the curved structure from the inside of the furnace.

The desirability of replacement of refractories from the cold side of curved nose construction in high temperature furnaces without disassembly of the entire length of the nose construction is taught in U.S. Pat. No. 4,463,689. The U.S. Pat. No. 4,463,689 does achieve the ability of replacement of a small number of refractory bricks from the cold side of the high temperature furnace, but cannot be used in the refractory wall system providing for direct fluid cooling of the metallic hangers.

SUMMARY OF THE INVENTION

It is an object of the present invention to provide a refractory shield removable toe construction whereby a plurality of refractories extending upwardly from the lowermost refractory in a suspended curved portion of a refractory wall may be readily replaced from the exterior of the furnace.

It is another object of this invention to provide a refractory shield removable toe construction suitable for use with metallic refractory hanger cooling systems wherein the hangers are suspended from an opening in a cooling fluid tube.

In one embodiment of this invention, a refractory shield removable toe assembly is provided with a hanger suspension means extending substantially the length of said toe assembly from which metallic refractory hangers are hung with their downwardly extending portions engaging openings in adjacent refractory bricks so that a pair of refractory bricks are face-to-face adjacent each other suspended by a single hanger. Adjacent pairs of refractory bricks may be suspended from a single hanger, as known to the art. The refractory bricks may be wedge-shaped with their narrower portion toward the outer surface of a furnace wall to provide the desired toe or nose curvature. The outer end of the hanger suspension means has a downwardly extending structure, such as a plate, positioned to support the lowermost or outermost refractory brick in desired position with respect to the hanger suspension means. Extending upwardly from the hanger suspension means is a toe assembly suspension means which may be of any suitable shape having a lifting means in an outer upward location outwardly from a vertical axis passing through the center of gravity of the refractory shield removable toe assembly and having a hanging means positioned in an inner upward location inwardly from a vertical axis passing through the center of gravity of the toe assembly. When an installed toe assembly is lifted by the lifting means, the hanging means disengages its fixed mounting means on the fixed refractory structure placing the removable toe assembly weight on the lifting means pivoting the removable toe assembly about the lifting point separating it outwardly from the fixed refractory structure of the suspended wall. In this manner, the refractory bricks associated with a single refractory hanger suspension means may be removed from cold side of the furnace as a refractory removable toe assembly. Likewise, the refractory removable toe assembly may be readily placed in position adjacent the fixed refractory wall by lifting the toe assembly at its lifting point and engaging the hanging means with the fixed mounting means on the fixed refractory structure and releasing the lifting force thereby placing the removable toe assembly weight on the hanging means causing the entire refractory toe assembly to rotate upwardly with the innermost face of the innermost refractory engaging the outermost face of the outermost refractory in the fixed suspended wall. In the same fashion, when a fluid cooled refractory suspension system is used, the hanger suspension means of the removable toe assembly may be a tube which engages the adjacent hanger suspension tube of the fixed suspended refractory wall to supply cooling fluid to the removable toe assembly when in place.

BRIEF DESCRIPTION OF THE DRAWING

Further features and advantages of the invention will be apparent from the following more detailed description of preferred embodiments read in conjunction with the drawing wherein.

DESCRIPTION OF PREFERRED EMBODIMENTS

Figure 1:
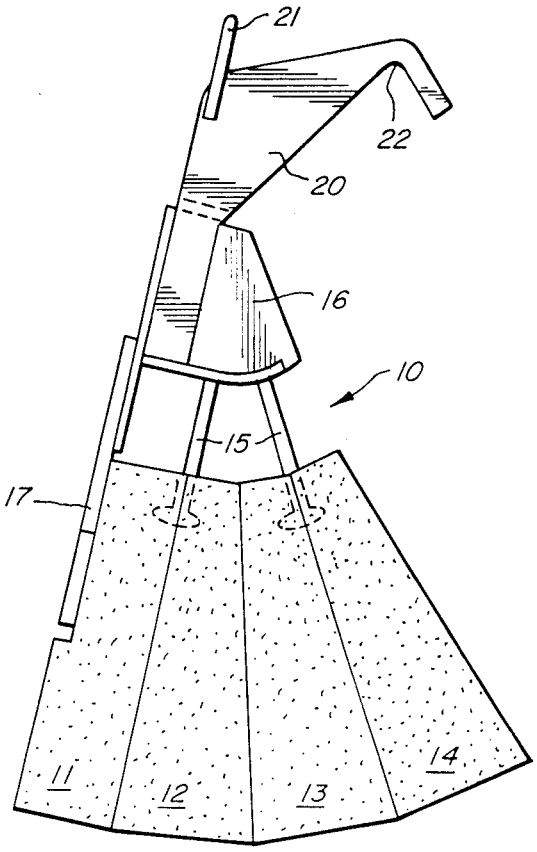
FIG. 1 is a side view of a removable toe assembly according to a preferred embodiment of the invention.

Refractory shield removable toe assembly 10 is shown in FIG. 1 having outer refractory 11 and inner refractory 14 with refractories 12 and 13 therebetween. Suitable removable toe assemblies according to this invention may have from 2 to about 12 individual refractories with 2 to about 6 refractories being aligned in a single row. When metallic refractory hangers as described in U.S. Pat. No. 3,812,798 are used, two rows of refractories are suspended from a single row of metallic refractory hangers. The removable toe assembly according to the present invention may have either a single or a double row of refractories suspended from a single hanger suspension means 16 by a single row of metallic refractory hangers 15. Suitable metallic refractory hangers for suspending refractories in face-to-face adjacent positions are known to the art and any hanger design so suspending refractories from a hanger suspension means are suitable for use in this invention. Hanger suspension means 16 may be any suitable structural shape extending substantially the length of the removable toe assembly. The terminology "length" refers to the distance of the outer face of the outermost refractory 11 to the inner face of innermost refractory 14 in the toe assembly. It will be apparent that hanger suspension means 16 can be up to about 25 percent longer or shorter than the length of the toe assembly without departing from this invention. In a preferred embodiment, hanger suspension means 16 is a hollow tube with a plurality of openings for receiving one end of metallic refractory hangers 15 and for passage of cooling fluid outwardly at the openings, thereby directly cooling the metallic refractory hangers 15, for use in conjunction with the fixed portion of a refractory shield as taught by U.S. Pat. No. 3,812,798.

Figure 2:
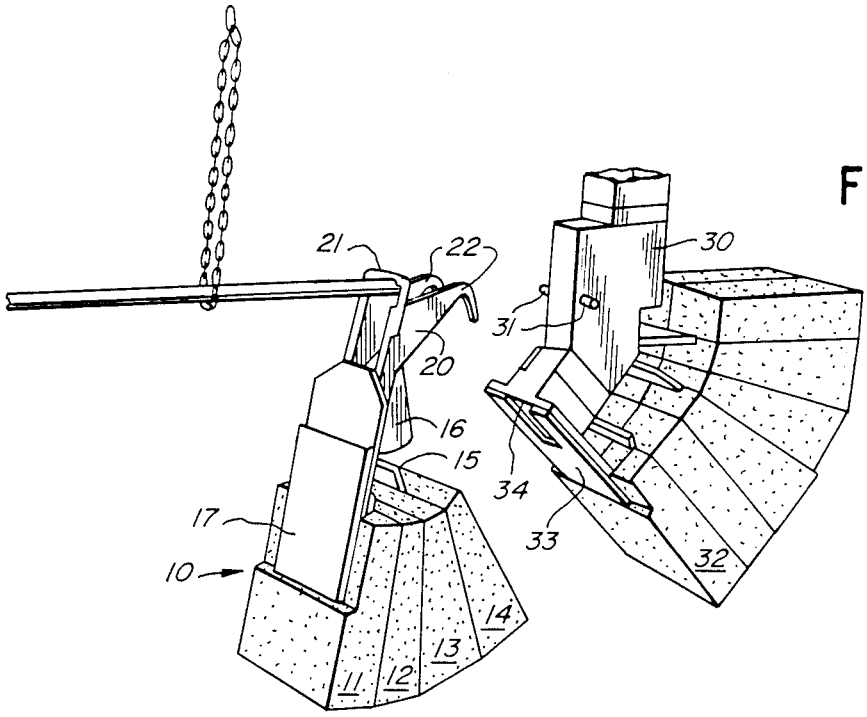
FIG. 2 is a perspective view showing the removable toe assembly of FIG. 1 being installed on a fixed suspended refractory structure.
Figure 3:
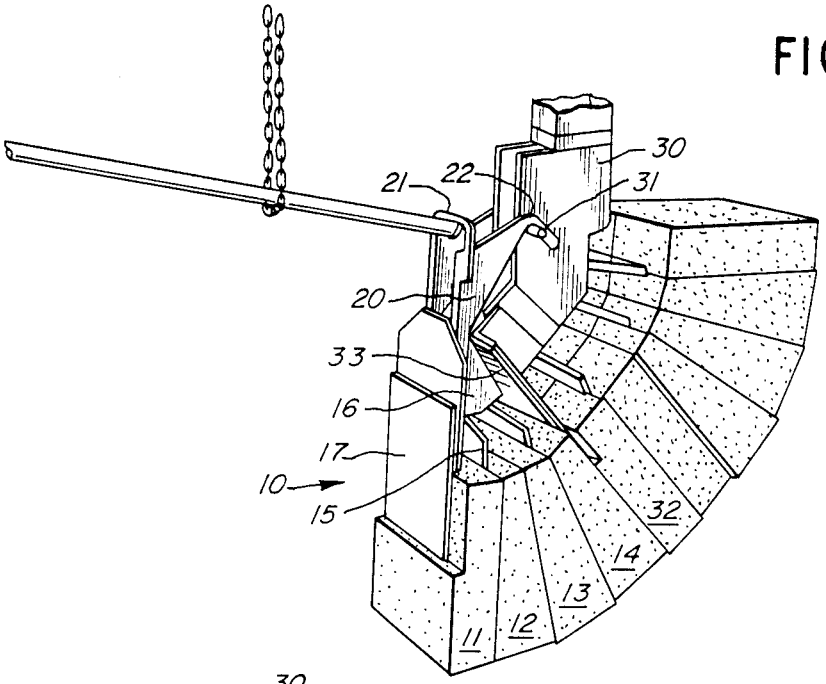
FIG. 3 is a perspective view showing the removable toe assembly in position on a fixed suspended refractory structure.
Figure 4:
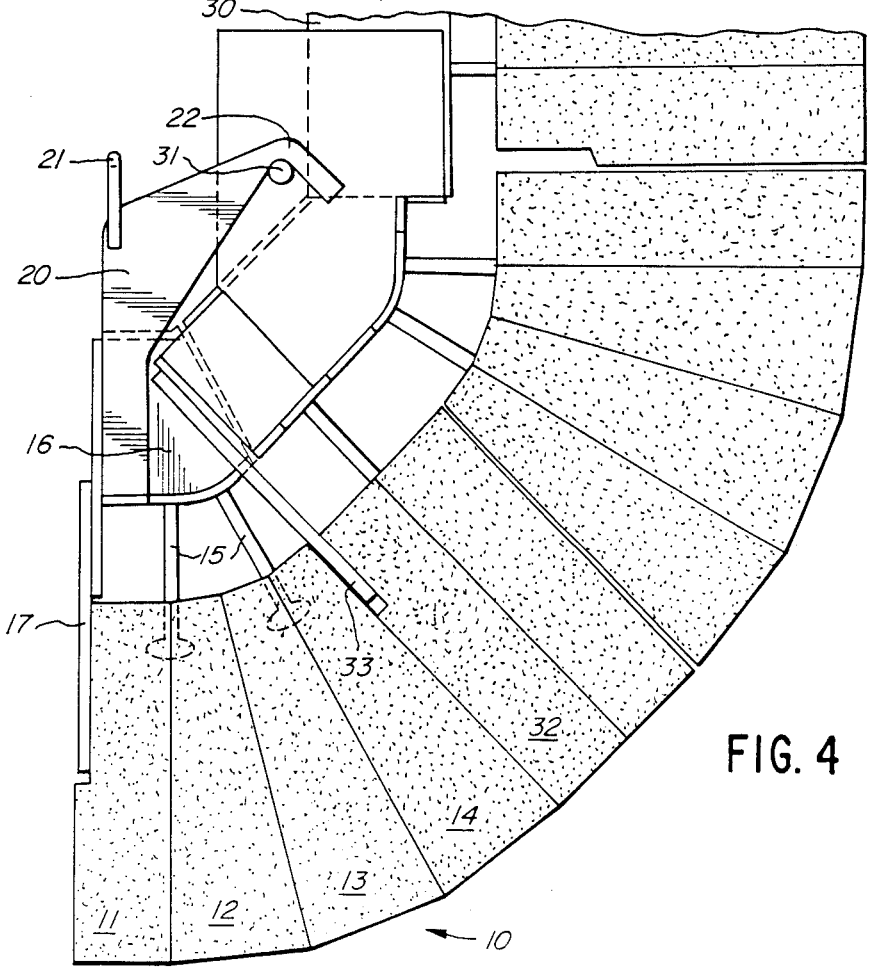
FIG. 4 is a side view of the installed removable toe assembly.

At the outer end of hanger suspension means 16 refractory support means 17 extends downwardly positioned to hold outer refractory 11 in desired position with respect to hanger suspension means 16. Toe assembly suspension means 20 extends upwardly from hanger suspension means 16 and has lifting means 21 positioned in an outer upward location outwardly from a vertical axis through the center of gravity of the removable toe assembly. Toe assembly suspension means 20 also has hanging means 22 positioned in an inner upward location inwardly from the vertical axis through the center of gravity of the toe assembly and shaped for downward engagement with fixed mounting means 31 at the lower portion of suspended curtain wall support 30 as shown in FIGS. 2–4 in a location such that removable toe assembly 10 rotates inwardly urging the inner face of inner refractory 14 against the outer face of the outermost fixed refractory 32 of the fixed portion of the suspended refractory shield. Toe assembly suspension means 20 may be centrally located with respect to hanger suspension means 16 so that it is over the center of the gravity with respect to the width of the removable toe assembly or, preferably, may comprise two generally plate structures, one located on each side of hanger suspension means 16 and symmetrical with respect to the center of gravity with respect to the width of the removable toe assembly so that when the weight of the removable toe assembly is placed upon lifting means 21 or hanging means 22, the assembly hangs substantially symmetrical with respect to a vertical axis through its center of gravity. Lifting means 21 may be any suitable shape for engagement with a lifting hook. Hanging means 22 is preferably in the shape of an inverted V allowing free rotation about a fixed mounting means 31 over which it is placed. Fixed mounting means 31 may be attached to the fixed portion of the suspended refractory wall support 30 and is preferably in the form of a round bar to permit the desired free rotation of the removable toe assembly when its weight is upon the fixed mounting means through hanging means 22.

As best seen in FIGS. 2–4, one preferred embodiment of this invention utilizes a suspended refractory wall support in tubular form to supply support and a cooling fluid directly to the metallic refractory hangers of the fixed portion of the suspended refractory wall. The outermost or bottommost fixed refractory 32 of the curved portion of the suspended refractory wall is supported by plate 33 affixed to the end of the suspended refractory wall support 30. In this embodiment, hanger suspension means 16 is in the form of a slotted tube dimensioned to coact with the open end 34 of suspended refractory wall support 30 so that cooling fluid is supplied to metallic refractory hangers 15 of removable toe assembly 10 when in place as shown in FIGS. 3 and 4.

For installation, removable toe assembly 10 is lifted by lifting means 21 and positioned, from the outside of the furnace structure, such that hanging means 22 comes into engagement with fixed mounting means 31. While the weight of removable toe assembly 10 is supported by lifting means 21 the inner face of the inner refractory 14 of removable toe assembly 10 is spaced from the outer face of outermost refractory 32 of the fixed portion of the refractory wall permitting engagement of hanging means 22 with fixed mounting means 31. Upon transfer of the weight of removable toe assembly 10 to hanging means 22, removable toe assembly 10 rotates about fixed moun-ting means 31 urging the inner face of inner refractory 14 against the outer face of outermost fixed refractory 32.

Removal of toe assembly 10 is achieved in the opposite fashion, simply by lifting it by lifting means 21 disengaging hanging means 22 from fixed mounting means 31 whereby the inner face of inner refractory 14 separates from the outer face of outermost fixed refractory 32 due to gravity.

It is readily apparent that a single removable toe assembly may be removed from a central position along a curved wall portion without disturbing the adjacent removable toe assemblies. Thus, in a suspended refractory wall system having the lowermost or outermost plurality of refractories which are most subject to heat and chemical damage in the form of removable toe assemblies, a single removable toe assembly may be replaced with new bricks without disruption of furnace operation.

Refractories, metallic refractory hangers, hanger suspension means and components of construction of the removable toe assembly of this invention may be manufactured from materials and by processes known to the art which will be apparent upon reading this disclosure.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A removable refractory shield toe assembly for a suspended refractory shield comprising: a hanger suspension means extending substantially the length of said toe assembly, a plurality of adjacent refractories suspended by at least one metallic refractory hanger, each said refractory hanger engaged in said hanger suspension means, a refractory support means extending downwardly from said hanger suspension means outer end and positioned to hold the outer of said plurality of refractories in desired position with respect to said hanger suspension means, a toe assembly suspension means extending upwardly from said hanger suspension means having lifting means positioned in an outer upward location outwardly from a vertical axis through the center of gravity of said removable toe assembly and having hanging means positioned in an inner upward location inwardly from said vertical axis, whereby said removable toe assembly rotates outwardly spacing the inner face of the innermost of said plurality of refractories from the outer face of the outermost fixed refractory of said suspended refractory shield when the weight of said removable toe assembly is upon said lifting means and said removable toe assembly rotates inwardly urging said inner face against said outer face when the weight of said removable toe assembly is upon said hanging means.

2. A removable refractory shield toe assembly according to claim 1 wherein said plurality comprises 2 to about 12 refractories.

3. A removable refractory shield toe assembly according to claim 1 having 2 to about 6 refractories aligned in a row.

4. A removable refractory shield toe assembly according to claim 1 wherein said refractory support means comprises a flat plate.

5. A removable refractory shield toe assembly according to claim 1 wherein said toe assembly suspension means comprises a plate extending upwardly from each side of said hanger suspension means.

6. A removable refractory shield toe assembly according to claim 1 wherein said hanging means is in the shape of an inverted V.

7. A removable refractory shield toe assembly according to claim 1 having 2 to about 6 refractories aligned in a row; said refractory support means comprises a flat plate; said toe assembly suspension means comprises a plate extending upwardly from each side of said hanger suspension means; and said hanging means is in the shape of an inverted V.

8. In a mounting means for a suspended refractory shield for a high-temperature furnace of the type having a hollow hanger tube provided with mounting means attaching to a support beam and depending from said support beam, and having at least one open end and one face with a plurality of longitudinally arranged oblong openings in said face; metal hanger means for supporting said refractory shield, said hanger means having a body portion and at one end opposed side lugs, said side lugs being adapted to be received within one of said oblong openings and abutting the inner surface of said hanger tube adjacent said opening and holding means at the other end of said body portion adapted to engage and hold refractory brick forming a part of the refractory shield; a cooling fluid supply means operatively communicating with said hanger tube through an open end of said hanger tube; said oblong opening receiving the body portion of said hanger means having a cross-sectional area which is greater than the cross-sectional area of the received body portion, the cooling fluid introduced at one end of said hollow hanger tube flowing the length of said tube passing outwardly at said oblong openings thereby cooling said metal hanger means, the improvement comprising: a removable refractory shield toe assembly comprising: a tubular hanger suspension means extending substantially the length of said toe assembly, a plurality of adjacent refractories suspended by at least one metallic refractory hanger, each said refractory hanger engaged in an opening in said tubular hanger suspension means, a refractory support means extending downwardly from said hanger suspension means outer end and positioned to hold the outer of said plurality of refractories in desired position with respect to said hanger suspension means, a toe assembly suspension means extending upwardly from said hanger suspension means having lifting means positioned in an outer upward location outwardly from a vertical axis through the center of gravity of said removable toe assembly and having hanging means positioned in an inner upward location inwardly from said vertical axis, whereby said removable toe assembly rotates outwardly spacing the inner face of the innermost of said plurality of refractories from the outer face of the outermost fixed refractory of said suspended refractory shield when the weight of said removable toe assembly is upon said lifting means and said removable toe assembly rotates inwardly urging said inner face against said outer face and aligning said tubular hanger suspension means of said removable toe assembly with said hollow hanger tube of said fixed refractory shield when the weight of said removable toe assembly is upon said hanging means.

9. In a mounting means according to claim 8 wherein said plurality comprises 2 to about 12 refractories.

10. In a mounting means according to claim 8 having 2 to about 6 refractories aligned in a row.

11. In a mounting means according to claim 8 wherein said refractory support means comprises a flat plate.

12. In a mounting means according to claim 8 wherein said toe assembly suspension means comprises a plate extending upwardly from each side of said hanger suspension means.

13. In a mounting means according to claim 8 wherein said hanging means is in the shape of an inverted V.

14. In a mounting means according to claim 8 wherein a fixed mounting means is attached to said hanger tube at a location near its lower end and positioned to provide said rotation and alignment when said hanging means is engaged therewith.

15. In a mounting means according to claim 8 having 2 to about 6 refractories aligned in a row; said refractory support means comprises a flat plate; said toe assembly suspension means comprises a plate extending upwardly from each side of said hanger suspension means; and said hanging means is in the shape of an inverted V.

16. A method of replacing a plurality of lowermost refractories from the exterior of a suspended curved refractory construction having its center of radius of curvature outside the cold side of a high temperature furnace suspended refractory shield comprising lifting an installed refractory shield removable toe assembly by a lifting means and removing said removable toe assembly, said toe assembly comprising a hanger suspension means extending substantially the length of said toe assembly, a plurality of adjacent refractories suspended by at least one metallic refractory hanger, each said refractory hanger engaged in said hanger suspension means, a refractory support means extending downwardly from said hanger suspension means outer end and positioned to hold the outer of said plurality of refractories in desired position with respect to said hanger suspension means, a toe assembly suspension means extending upwardly from said hanger suspension means having lifting means positioned in an outer upward location outwardly from a vertical axis through the center of gravity of said removable toe assembly and having hanging means positioned in an inner upward location inwardly from said vertical axis, whereby said removable toe assembly rotates outwardly spacing the inner face of the innermost of said plurality of refractories from the outer face of the outermost fixed refractory of said suspended refractory shield when the weight of said removable toe assembly is upon said lifting means and said removable toe assembly rotates inwardly urging said inner face against said outer face when the weight of said removable toe assembly is upon said hanging means, and lifting a replacement toe assembly of the same design into position by said lifting means engaging a fixed mounting means on said refractory construction with said hanging means placing said replacement toe assembly weight upon said hanging means, said toe assembly rotating inwardly urging said inner face against said outer face.

* * * * *